United States Patent [19]

Levine et al.

[11] 4,114,210

[45] Sep. 19, 1978

[54] SPRING ASSEMBLY WITH REINFORCEMENT

[75] Inventors: Alexander M. Levine, Boston; Henry R. Ramsey, Dudley, both of Mass.

[73] Assignee: Webster Spring Co. Inc., Oxford, Mass.

[21] Appl. No.: 805,513

[22] Filed: Jun. 10, 1977

[51] Int. Cl.[2] ..... A47C 23/04

[52] U.S. Cl. ..... 5/260; 5/259 R

[58] Field of Search ..... 5/259 R, 261, 351; 267/102, 110

[56] References Cited

U.S. PATENT DOCUMENTS

| | | | |
|---|---|---|---|
| 3,093,840 | 6/1963 | Martin | 5/260 |
| 3,206,759 | 9/1965 | Kline | 5/260 |
| 3,426,371 | 2/1969 | Robinson | 5/260 |
| 3,982,290 | 9/1976 | Ward | 5/260 |

*Primary Examiner*—Casmir A. Nunberg

*Attorney, Agent, or Firm*—Dike, Bronstein, Roberts, Cushman & Pfund

[57] ABSTRACT

The combination with a spring assembly of pairs of structures designed to be applied transversely to the top and bottom supporting surfaces at one or more longitudinally spaced intervals to enhance the resistance to sinking of the supporting surfaces, bowing at the longitudinal sides and collapse between the surfaces at the longitudinal sides comprising pairs of elongate parts which extend transversely across the assembly at the top and bottom sides from one longitudinal side to the other, said parts being transversely inextensible and resistant to flexing and at one end thereof a polygonal structure disposed between the border wires in the plane of the sides, two sides of which, the top and bottom, are parallel to the border wires and the other two sides of which embody oppositely disposed spring arms.

1 Claim, 3 Drawing Figures

SPRING ASSEMBLY WITH REINFORCEMENT

BACKGROUND OF INVENTION

In our pending application Ser. No. 769,460, filed Feb. 17, 1977, there are disclosed several forms of reinforcing elements designed to be assembled to an innerspring assembly for the purpose of firming up the assembly, such devices being adapted to be built into the assembly at the time of manufacturing the assembly, or to be added to an already manufactured assembly to tailor the stiffness of the assembly to a customer's specification. The stiffening device which comprises the subject matter of this application constitutes an alternative form of structure designed for the same purposes as those shown in the aforesaid pending application.

SUMMARY OF INVENTION

As herein illustrated, the invention resides in pairs of structures adapted to be applied to the top and bottom supporting surfaces of a spring assembly transversely thereof at one or more longitudinally spaced intervals, each pair comprising two elongate parts which extend transversely across the spring assembly, one at the top side and one at the bottom side, from one longitudinal side to the other, said parts being transversely inextensible and resistant to flexing and each part having at one end thereof a polygonal structure disposed between the border wires and the plane of the sides, two sides of which, the top and bottom, are parallel to the border wires and the other two sides of which embody oppositely disposed spring arms. The top and bottom sides are fastened to the border wires. The opposite end of each elongate part has a bent end, a portion of which is parallel to the border wire and fastened thereto. Desirably, the bent end is inclined downwardly with respect to the top portion of the polygonal structure so that, when installed, the elongate part is subjected to mild torsion or twist.

The invention will now be described in greater detail with reference to the accompanying drawings, wherein.

Figure 2:
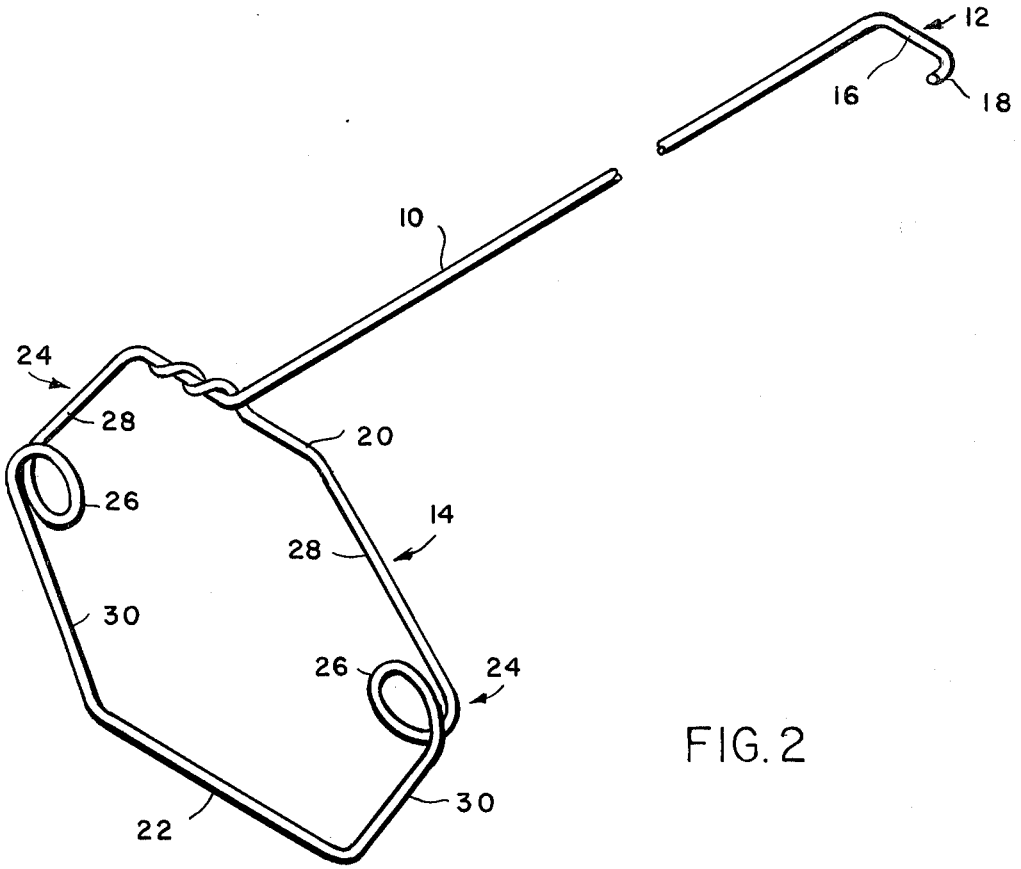
FIG. 2 is an isometric of one of the structures removed from the spring assembly.

Referring to the drawings, FIG. 2, the structure according to this invention comprises a part 10 of a length to extend transversely of the spring assembly, at one end of which there is a bent portion in the form of a hook 12 and at the other end of which there is a polygonal structure 14 connected to the part 10 with its plane perpendicular to the axis of the part 10. The bent portion 12 comprises a part 16 which is inclined downwardly relative to the top of the polygonal portion 14 and a part 18 which extends inwardly therefrom parallel to the part 10. The polygonal portion 14 comprises a top part 20, a bottom part 22 parallel thereto, and two oppositely disposed sides 24—24, each of which embodies torsion coils 26—26 of one or more loops and arms 28 and 30 which are connected, respectively, with the top and bottom parts 20 and 22. The planes of the torsion coils 26—26 lie in the plane of the polygonal structure and, hence, perpendicular to the part 10.

Figure 3:
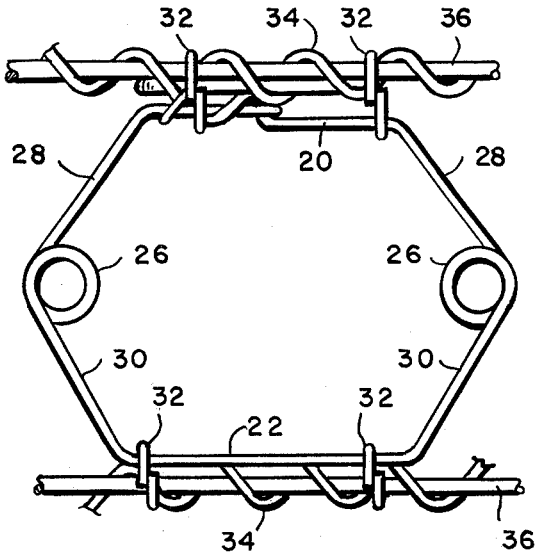
FIG. 3 is a fragmentary elevation at one side of the spring assembly showing the device as it is installed.
Figure 1:
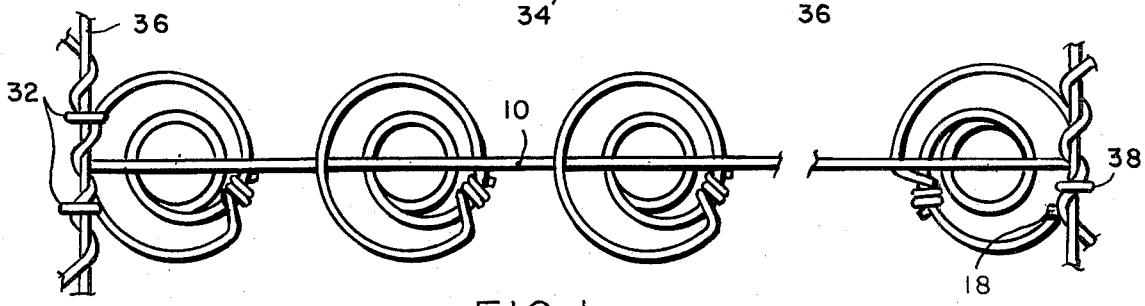
FIG. 1 is a fragmentary plan view of a spring assembly as seen, for example, from the top or bottom side with a reinforcing structure installed between the opposite border wires on the line of centers of a row of coils.

Two of these structures are applied to the spring assembly, one above the other, with the polygonal structure of one at one side of the spring assembly and the polygonal structure of the other at the other side as shown in FIGS. 1 and 3.

The plane of each of the polygonal structures is disposed in the plane of the side of the spring assembly and the upper and lower parts 20 and 22 are attached to the top and bottom border wires with hog rings 32 or their equivalent, FIGS. 1 and 3. When thus fastened, the torsion springs 26—26 are situated substantially midway between the top and bottom border wires and at opposite sides of the line of centers of the coils along the top and bottom ends of which extend the part 10. The bent portion 12 comprises a part 16 which is inclined downwardly relative to the top of the polygonal portion 14 and a part 18 which extends inwardly therefrom parallel to the part 10. The polygonal portion 14 comprises a top part 20, a bottom part 22 parallel thereto, and two oppositely disposed sides 24—24, each of which embodies torsion coils 26—26 of one or more loops and arms 28 and 30 which are connected, respectively, with the top and bottom parts 20-and 22. The planes of the torsion coils 26—26 lie in the plane of the polygonal structure and, hence, perpendicular to the part 10.

Two of these structures are applied to the spring assembly, one above the other, with the polygonal structure of one at one side of the spring assembly and the polygonal structure of the other at the other side as shown in FIGS. 1 and 3.

The plane of each of the polygonal structures is disposed in the plane of the side of the spring assembly and the upper and lower parts 20 and 22 are attached to the top and bottom border wires with hog rings 32 or their equivalent, FIGS. 1 and 3. When thus fastened, the torsion springs 26—26 are situated substantially midway between the top and bottom border wires and at opposite sides of the line of centers of the coils along the top and bottom ends of which extend the part 10. The part 10 is threaded over and under successive loops at the top and bottom ends of the coils and the hook ends 12 are engaged within the spiral springs 34 by means of which the coils are attached to the border wires 36 and, since it is biased with respect to the polygonal structure, tends to lock itself in engagement with the spiral springs at the border wire and, hence, to resist displacement. Additionally, hog rings 38 or their equivalent are used to lock the hook ends 12 to the border wires.

The aforesaid structure provides the specific advantage that by employing two torsion springs, a ligher gauge may be used with the same effectiveness that a single heavier gauge coil spring would provide and a somewhat more stable structure is afforded by the fact that the spaced torsion springs distribute the pressure at equally spaced points at opposite sides of a transverse row of springs.

The primary consideration of the structure as shown herein as well as in the aforesaid pending application is to provide a structure which embodies the threefold function of resisting sinking at the center of the supporting surfaces, bowing at the opposite sides and collapse or softness at the sides and ends and it is considered that any such structure, whether of single or multiple wire construction, is embodied within the scope of this invention.

It is to be understood that while the transverse portions 10 of the structure are described as inextensible, they are conversely axially incompressible so that they act as struts which not only prevent bowing of the sides outwardly, but bowing of the sides inwardly.

The structures have been described as composed of wire such as conventionally used by spring manufacturers for making springs; however, it is within the scope of the invention to employ plastic extruded in the form of wire of suitable cross section.

It should be understood that the present disclosure is for the purpose of illustration only and includes all modifications or improvements which fall within the scope of the appended claims.

We claim:

1. In a spring assembly including upper and lower border wires of rectangular configuration and a plurality of longitudinally-spaced, transversely-extending rows of coils, said coils being connected at their upper and lower ends to the border wires and to each other; pairs of elongate stiffening elements disposed transversely of the assembly along the top and bottom ends of the coils in a row of coils, said stiffening elements each comprising an inextensible wire strand of such stiffness as to afford appreciable resistance to bending, a hook at one end and means at the other end resistant to compression in a plane perpendicular to the strand, said hook comprising a first part at right angles to the strand and a second part at right angles to the first part, parallel to the strand extending toward the opposite end and said means resistant to compression comprising a loop at said end, the plane of which is perpendicular to the strand, said loop comprising a top part parallel to the first part at the opposite end of the strand, a bottom part spaced from and parallel thereto and spaced V-shaped side parts, each comprising a single loop of wire at the apex and a pair of sloping arms connected to the top and bottom parts, said V-shaped side parts being disposed with their arms sloping toward each other and with the loops situated midway between the top and bottom parts and laterally of the ends of the top and bottom parts, said elements being comprised of a single length of wire and being adapted to be applied one at the top side and the other at the bottom side of the assembly from opposite sides thereof by weaving of the strands alternately above and below the upper and lower ends of the coils and to be anchored at the opposite ends by clamp rings which clamp, respectively, the hooks at one end to the border wires and the loops at the other ends to the border wires.

* * * * *